US009132540B2

(12) United States Patent
Jonsson

(10) Patent No.: US 9,132,540 B2
(45) Date of Patent: Sep. 15, 2015

(54) HYDRAULIC PERCUSSIVE ARRANGEMENT, PISTON GUIDE AND DRILLING RIG

(75) Inventor: Per Jonsson, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 568 days.

(21) Appl. No.: 13/261,412

(22) PCT Filed: Mar. 22, 2011

(86) PCT No.: PCT/SE2011/050313

§ 371 (c)(1),
(2), (4) Date: Aug. 27, 2012

(87) PCT Pub. No.: WO2011/123020

PCT Pub. Date: Oct. 6, 2011

(65) Prior Publication Data

US 2013/0000939 A1 Jan. 3, 2013

(30) Foreign Application Priority Data

Apr. 1, 2010 (SE) ..... 1050316

(51) Int. Cl.
*E21B 31/113* (2006.01)
*B25D 17/06* (2006.01)
*B25D 9/12* (2006.01)

(52) U.S. Cl.
CPC *B25D 9/12* (2013.01); *B25D 17/06* (2013.01); *B25D 2217/0019* (2013.01); *B25D 2250/365* (2013.01)

(58) Field of Classification Search
CPC ..... E21B 31/113; B25D 9/12; B25D 17/06; B25D 2250/035
USPC ..... 173/200, 206–208
See application file for complete search history.

(56) References Cited

U.S. PATENT DOCUMENTS

| | | | |
|---|---|---|---|
| 4,425,838 | A | 1/1984 | Pippert |
| 6,119,795 | A | 9/2000 | Lee |
| 6,145,842 | A | 11/2000 | Zellers et al. |
| 6,367,805 | B1 | 4/2002 | Radcliffe et al. |
| 7,152,692 | B2 | 12/2006 | Hurskainen et al. |
| 7,607,383 | B2 | 10/2009 | Nagel |
| 2007/0068707 | A1 | 3/2007 | Henriksson et al. |
| 2008/0135270 | A1 | 6/2008 | Henriksson |

FOREIGN PATENT DOCUMENTS

| | | | |
|---|---|---|---|
| EP | 0071546 | A1 | 2/1983 |
| WO | WO 2008/051146 | A1 | 5/2008 |

*Primary Examiner* — Michelle Lopez
(74) *Attorney, Agent, or Firm* — Mark P. Stone

(57) ABSTRACT

The present invention relates to a hydraulic percussive arrangement comprising a displaceable arrangement (1) in a casing (11), in which casing (11) the following are arranged at the displaceable arrangement (1): a first chamber (5) connected to a return line (7) for hydraulic oil, a bushing (6) on a first side of the first chamber (5) and separated from the first chamber (5) by a first gap (12) along the displaceable arrangement (1), and a second chamber (2) with a higher pressure of hydraulic oil than that of the first chamber (5) and arranged on a second side of the first chamber (5), separated from the first chamber (5) by a second gap (4) along the displaceable arrangement (1). According to the invention, a third chamber (8) is fixed arranged between the second gap (4) and the first chamber (5) and the third chamber (8) is connected to the first chamber (5) not only by a first passage (14) but also by a third gap (9) along the displaceable arrangement (1). The invention relates also to a piston guide in such a hydraulic percussive arrangement and to a drilling rig with such a percussive arrangement.

20 Claims, 6 Drawing Sheets

HYDRAULIC PERCUSSIVE ARRANGEMENT, PISTON GUIDE AND DRILLING RIG

TECHNICAL AREA

The present invention relates to a hydraulic percussive arrangement according to the introduction to claim 1.

THE PRIOR ART

A percussive hydraulic rock drilling machine includes a casing in which an impact piston moves forwards and backwards and impacts upon a shank adapter. Furthermore, rotation is transferred to the shank adapter from a rotary motor. Impact energy and rotation are subsequently transferred from the shank adapter through one or several drill rods and a drill bit to the rock, such that a borehole is created.

One or several bushings are arranged for the sealing of the impact piston. Several solutions are available to ensure that the load on the bushings is low and that their lifetime as long as possible. U.S. Pat. No. 7,152,692 reveals an arrangement for a hydraulic hammer that it would be possible to use also for a drilling machine. A first chamber in the immediate vicinity of the piston bushing is drained to the return line for hydraulic oil such that the bushing is to be subject to as low a pressure of hydraulic oil as possible. A second chamber with a high pressure of hydraulic oil is separated from the said first chamber by a gap that is formed between the piston and the casing.

The disadvantage of prior art technology is that the pressure difference in the gap between the piston and the casing, which pressure difference is between the second chamber with its high pressure of hydraulic oil and the drained first chamber, will force hydraulic oil along the longitudinal direction of the gap. In the case in which the piston has a velocity in the same direction as the hydraulic oil is being driven by the pressure, the speed and the volume of fluid will be large. This hydraulic oil flows out at high speed in a film along the surface of the piston and makes contact with the piston bushing. The hydraulic oil not only causes erosion, which shortens the lifetime of the bushing: it also causes the bushing ring to partially lift, which causes leakage.

In the cases in which the piston bushing includes two bushings in series, pressure is established in these cases between the bushings, which causes the inner bushing to turn onto its edge and the outer bushing to become extruded along the piston. A complete failure of the bushing combination is in this way obtained.

The same problem may arise in an equivalent manner for other moving components than pistons.

U.S. Pat. No. 6,367,805 reveals a piston in a piston compressor in which moving stripping rings are arranged around the piston in order to remove hydraulic oil from the surface of the piston. The stripping rings are not attached to either the casing of the compressor or the piston, and thus move freely and partially accompany the piston in its motion. The pressure of hydraulic oil in a drilling machine is higher; and the solution revealed by U.S. Pat. No. 6,367,805 would not function as well in this case. The rings wear on the piston and on each other. Further, the result depends very strongly on the instantaneous positions of the rings. Also, the rings occupy a great deal of space—particularly when one considers that they are to have space for motion and that they are not used for anything else. Also the large chamber in which the rings are located occupies space and weakens the casing.

DESCRIPTION OF THE INVENTION

The present invention relates to a hydraulic drilling machine comprising a displaceable arrangement, such as a piston, in a casing. The following are arranged in the casing at the displaceable arrangement: a first chamber connected to a return line for hydraulic oil, a bushing on the first side of the first chamber and separated from the first chamber by a first gap along the displaceable arrangement, and a second chamber with a pressure of hydraulic oil that is higher than that in the first chamber and arranged on a second side of the first chamber, separated from the first chamber by a second gap along the displaceable arrangement. A third chamber is, according to the invention, fixed arranged between the second gap and the first chamber. The third chamber is connected to the first chamber not only through a first passage but also through a third gap along the displaceable arrangement.

The advantages are that the invention reduces the load on the neighbouring bushing, such that the risk for failure of the sealing function is reduced and the operating time of the drilling machine is extended. This is achieved by the hydraulic oil being led along a diversion, and thus does not impact upon the bushing with as high a speed as that in prior art technology.

By arranging the third chamber in the casing, or in some other feature, such as a piston guide, fixed arranged in the casing, a predictable result is obtained and an arrangement that can withstand also higher pressures of hydraulic oil.

The third chamber is, according to one embodiment, arranged in a piston guide. The advantage of this is that the piston guide is used for two functions, and this gives a compact solution that does not occupy a great deal of space.

DESCRIPTION OF DRAWINGS

The invention will be described in more detail with the aid of a preferred embodiment and with reference to the attached drawings, of which.

PREFERRED EMBODIMENT

Figure 1:
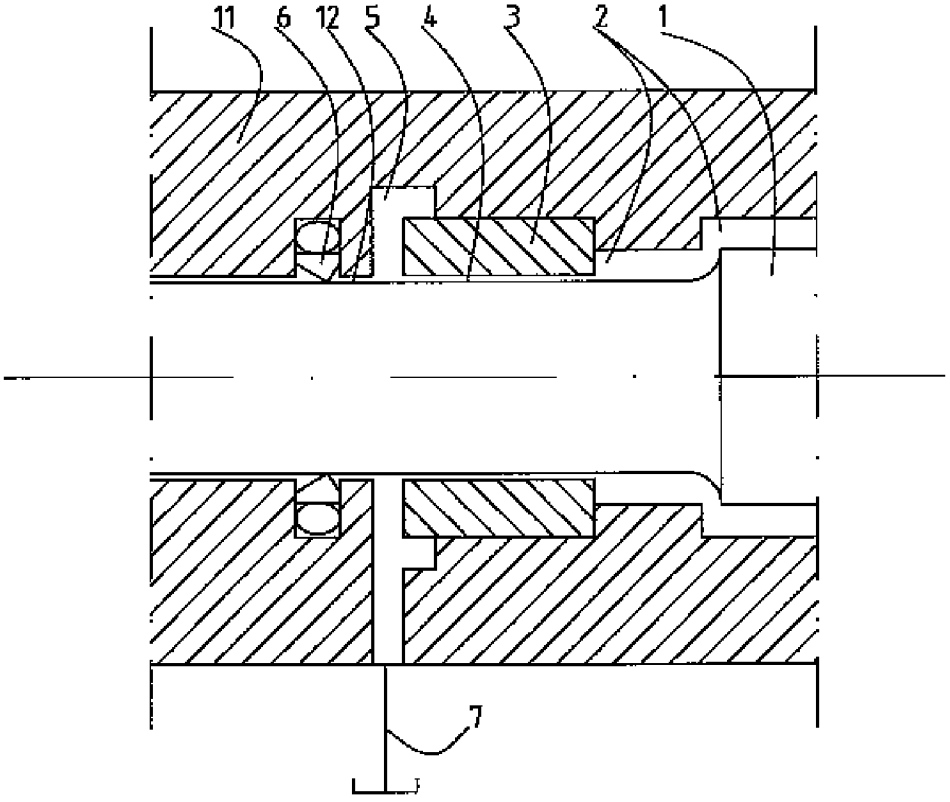
Fig. 1 (Prior Art)
FIGS. 1-3 show various variants of the prior art technology
Figure 2:
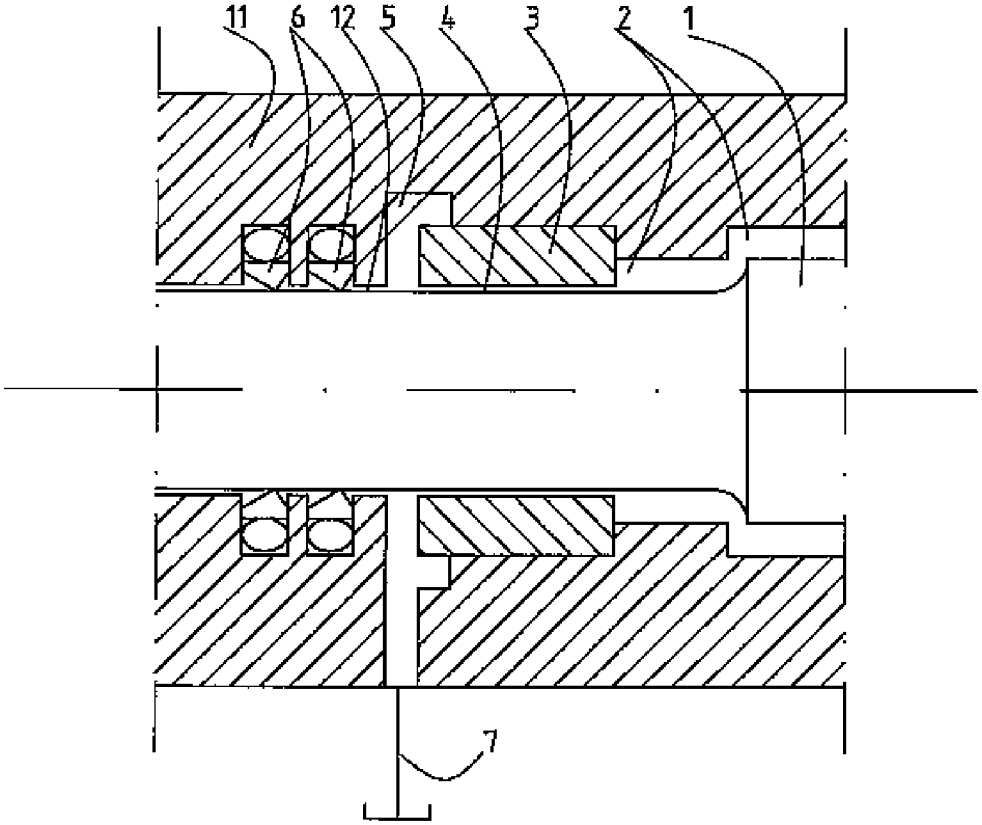
Fig. 2 (Prior Art)
Figure 3:
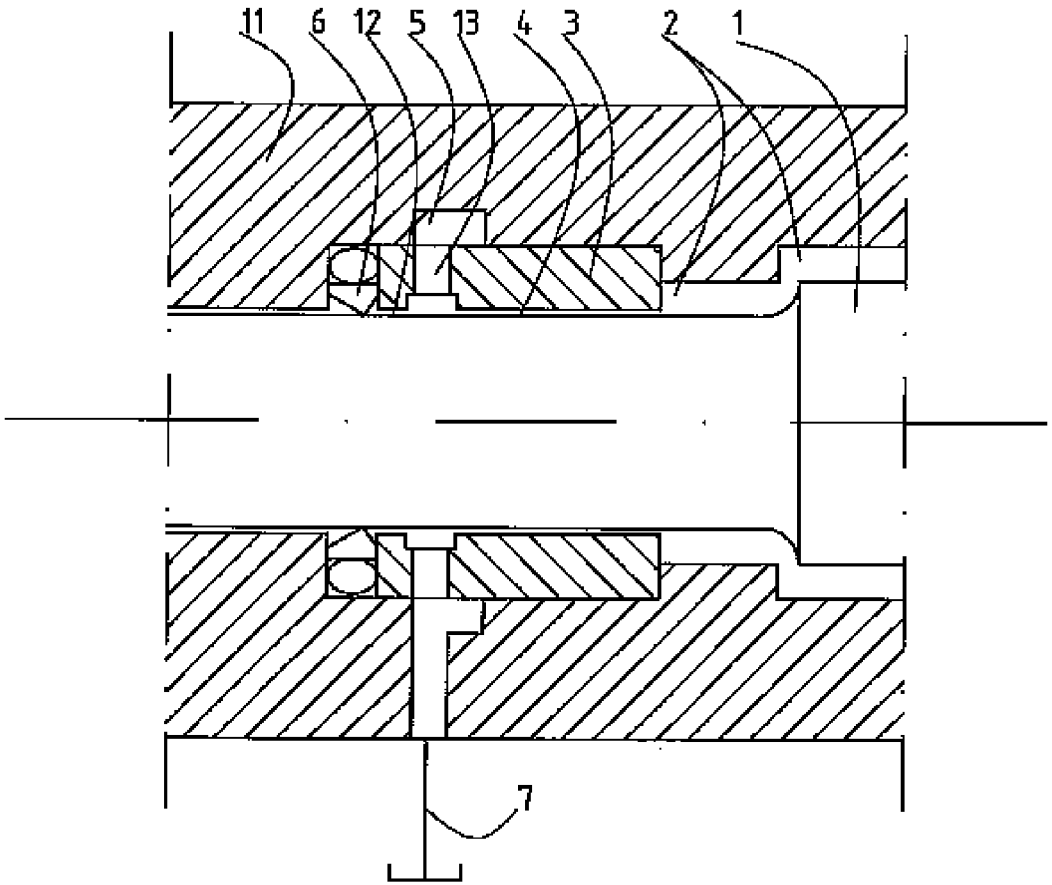
Fig. 3 (Prior Art)

FIGS. 1, 2 and 3 show part of a casing 11 of a hydraulic drilling machine. An impact piston 1 is arranged in the casing 11 in a more or less cylindrical compartment. The piston 1 moves backwards and forwards and impacts upon a shank adapter (not shown in the drawings) and transfers in this way impact energy onwards to a rock through one or several drill rods (not shown) and a drill bit (not shown). The piston has two lands that are driving areas for hydraulic pressure from a hydraulic oil that drives the piston 1 in a reciprocating motion. A piston guide 3 is arranged in the casing 11 at each end of the piston 1, such that the piston 1 always impacts directly onto the shank adapter, and in order to prevent the lands on the piston 1 making contact with the wall of the cylindrical compartment.

One or several bushings 6—see FIG. 1 and FIG. 2, respectively—are arranged for sealing against the piston 1. The bushing 6 is arranged on a first side of a first chamber 5 arranged in the casing 11. A first gap 12 along the piston 1 separates the bushing 6 from the first chamber 5. The first chamber 5 has a connection to a return line 7 for hydraulic oil, such that the bushing 6 is to be subject to as low a pressure of hydraulic oil as possible. On a second side of the first chamber 5 there are, in the casing 11, also one or several second chambers 2, which are at a high pressure of hydraulic oil. The second chamber 2 is separated from the first chamber 5 by a second gap 4 that is formed along the piston 1 between the piston guide 3 and the piston 1.

An alternative design that has the same function is shown in FIG. 3, where the piston guide 3 extends the complete distance to the bushing 6 and the drained first chamber 5 is arranged in the piston guide. A passage 13 in the piston guide 3 is arranged for connection of the first chamber 5 to the return line 7.

It is intended that hydraulic oil that emerges from the second chamber 2 at a high pressure of hydraulic oil will be drained out through the return line 7, without damaging the bushing 6. However, in the second gap 4 between the piston 1 and the piston guide 3, the pressure difference between the second chamber 2 with its high pressure of hydraulic oil and the drained first chamber 5 will force the hydraulic oil along the longitudinal direction of the second gap 4. In the case in which the piston 1 has a velocity in the same direction as the hydraulic oil is being driven by the pressure, the speed and the volume of fluid will be large. This hydraulic oil flows out at high speed in a film along the surface of the piston 1 and makes contact with the bushing 6. The hydraulic oil not only causes erosion, which shortens the lifetime of the bushing 6: it also causes the bushing 6 to partially lift, which causes leakage.

In the cases in which the piston bushing includes two bushings 6 in series, FIG. 2, pressure is established in these cases between the bushings 6, which causes the inner bushing 6 to turn onto its edge and the outer bushing 6 to become extruded along the surface of the piston 1. A complete failure of the bushing combination is in this way obtained.

Figure 4:
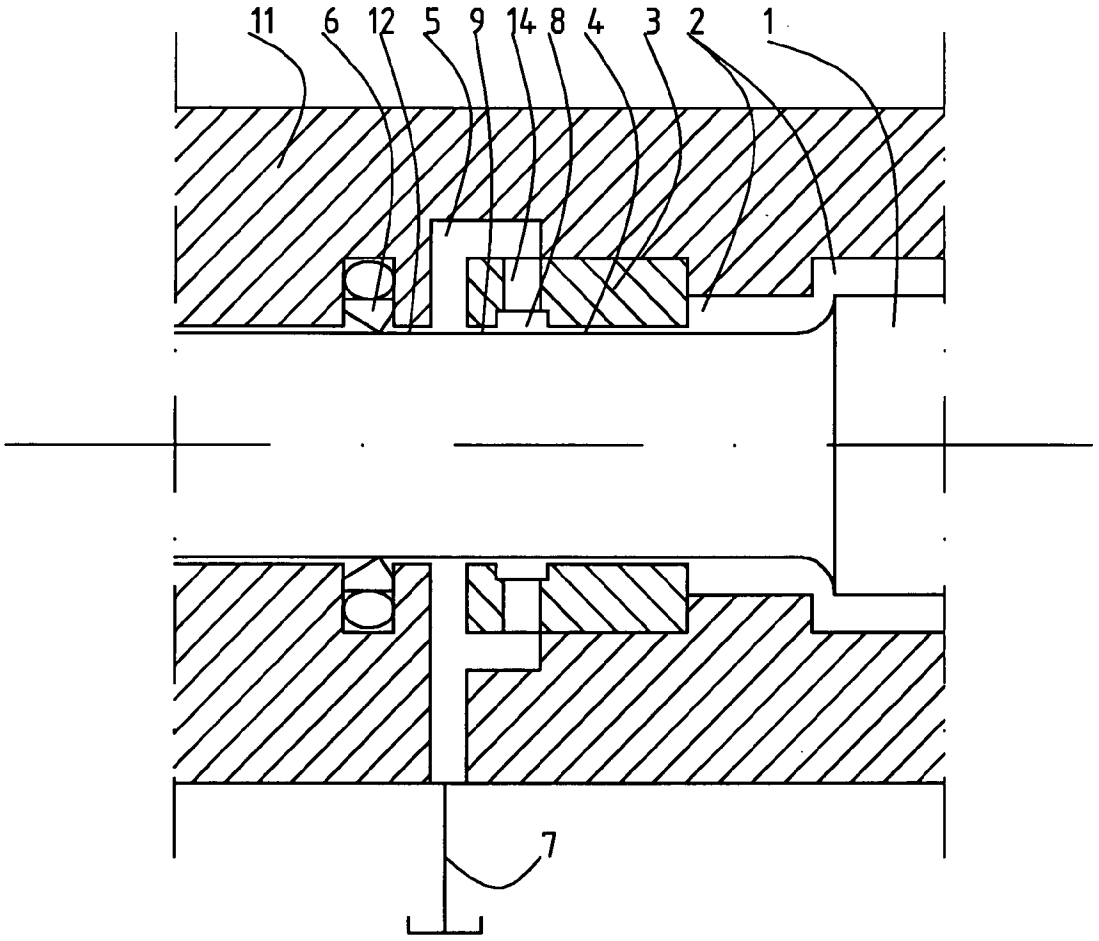
FIG. 4 shows a cross section through a first embodiment

FIG. 4 shows a first embodiment of the invention, which is intended to reduce the amount and speed of the oil film that flows along the piston 1 and impacts onto the bushing 6, such that the load on the bushing 6 is reduced. A third chamber 8 is arranged in the piston guide 3. A third gap 9 is arranged along the piston 1 between the third chamber 8 and the first chamber 5. Furthermore, a first passage 14 is arranged at another location between the third chamber 8 and the first chamber 5. The first passage 14 may include, for example, one or several holes. If the first passage 14 is larger than the third gap 9, hydraulic oil will flow freely through the first passage 14. It is appropriate that the cross-sectional area of the first passage 14 in the direction of flow be at least twice the cross-sectional area of the second gap 4.

The free flow of hydraulic oil through the first passage 14 ensures that the pressure of hydraulic oil in the third chamber 8 will be approximately the same as the pressure in the first chamber 5. There will thus be a negligible pressure gradient that drives the hydraulic oil through the third gap 9. Thus, most of the hydraulic oil is led through the first passage 14 into the first chamber 5 and out through the return line 7. This will prevent the greater part of the hydraulic oil that flows at high speed through the second gap 4 impacting upon the bushing 6, whereby the load on the bushing 6 is reduced.

Figure 5:
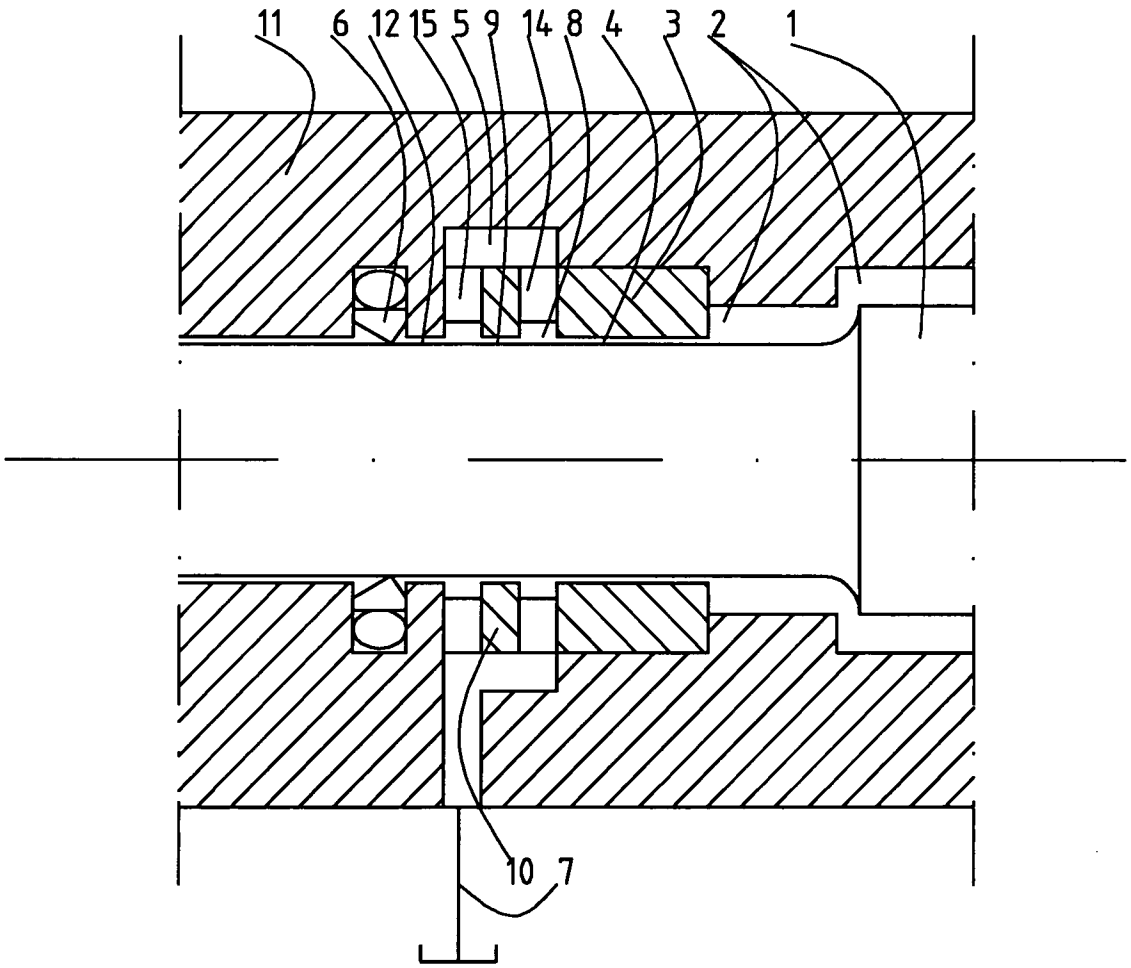
FIG. 5 shows a cross section through a second embodiment

FIG. 5 shows a design that is similar in function in which a separate bushing 10 is arranged between the piston guide 3 and the wall of the first chamber 5. The first passage 8 can in this case include first indentations 8 in the piston guide, which first indentations are in contact with the bushing 10. Alternatively, the first indentations 8 may be arranged in the bushing 10 and then be in contact with the piston guide 3. The bushing 10 has, furthermore, a second passage 15 for the connection of the first chamber 5 to the return line 7. The second passage may include second indentations 15 that are in contact with the wall of the first chamber 5.

Figure 6:
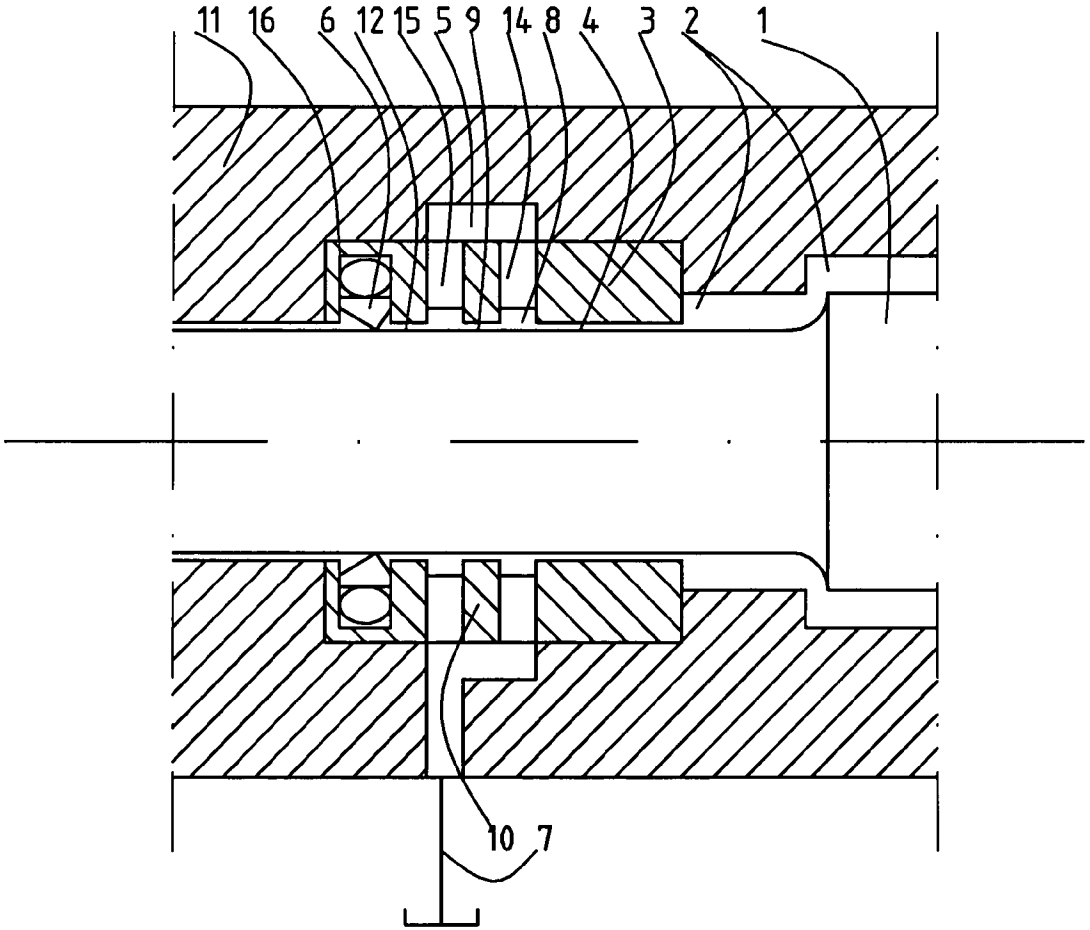
FIG. 6 shows a cross section through a third embodiment.

FIG. 6 shows a further design that is similar in function in which the bushing 10 contains also a fourth chamber 16 for the bushing 6. It is appropriate in this case that the second passage 15 include holes. An alternative is to omit a separate bushing 10, and to have the piston guide 3 to extend the complete distance and to include both the passages 14, 15 and the fourth chamber 16. It is appropriate in this case that both of the passages 14, 15 include holes.

The height of the third gap 9 should be approximately 0.5-10 times the height of the second gap 4. It is preferable that the second gap 4 and the third gap 5 be equally high. If the height of the third gap 9 is too small, wear will take place in the third gap 9. On the other hand, if the height of the third gap 9 is too large, too great a volume of hydraulic oil will run along this pathway. The latter condition is, however, a minor problem, when it is considered that the pressure gradient across the ends of the third gap 9 is low and that there is thus a wider range over which the invention functions.

It is appropriate that the length of the third gap 9 be approximately 50-500 times the height of the second gap 4. If the length of the third gap 9 is too short, too small an effect is obtained: if the length of the third gap 9 is too large, this affects the length of the complete drilling machine in a disadvantageous manner.

An impact piston has been specified in all of the examples, but it is obvious that the solution will function with other displaceable arrangements such as, for example, damping pistons. In the same way, it is not necessary to arrange the third chamber 8 in the piston guide 3: the third chamber 8 can be arranged directly in the wall of the casing 11 or in another arrangement fixed in the casing 11.

Examples with one bushing 6 are shown in the drawings, but the invention provides the same protection for two or more bushings 6 in tandem. The prior art solution shown in FIG. 2 should be compared in this case. Also other sensitive parts than bushings can be protected in the same manner.

It is possible also to have several third chambers 8 with third gaps 9 in series, in order to increase the effect.

The invention functions not only in drilling machines, but also in, for example, hydraulic hammers and other similar arrangements with similar problems.

The invention is, naturally, not limited to the example described above: it can be modified within the scope of the attached patent claims.

The invention claimed is:

1. A hydraulic percussive arrangement comprising a displaceable arrangement is a casing, in which casing the following are arranged at the displaceable arrangement: a first chamber connected to a return line for hydraulic oil, a bushing on a first side of the first chamber and separated from the first chamber by a first gap along the displaceable arrangement, and a second chamber with a higher pressure of hydraulic oil than that of the first chamber and arranged on a second side of the first chamber, separated from the first chamber by a second gap along the displaceable arrangement, wherein a third chamber is fixed arranged between the second gap and the first chamber, and wherein the third chamber is connected to the first chamber not only by a first passage but also by a third gap along the displaceable arrangement.

2. The hydraulic percussive arrangement according to claim 1, wherein the displaceable arrangement is a piston, such as an impact piston or a damping piston.

3. The hydraulic percussive arrangement according to claim 2, wherein the third chamber is arranged in a piston guide arranged in the casing.

4. The hydraulic percussive arrangement according to claim 3, wherein the piston guide further includes a fourth chamber for the bushing.

5. The hydraulic percussive arrangement according to claim 2, wherein the third chamber is arranged between a piston guide arranged in the casing and a bushing arranged in the casing.

6. The hydraulic percussive arrangement according to claim 5, wherein the bushing arranged in the casing further includes a fourth chamber for the bushing on the first side of the first chamber.

7. The hydraulic percussive arrangement according to claim 2, wherein the height of the third gap is 0.5-10 times the height of the second gap.

8. The hydraulic percussive arrangement according to claim 2, wherein the length of the third gap is 50-500 times the height of the second gap.

9. The hydraulic percussive arrangement according to claim 2, wherein the cross-sectional area of the first passage is at least twice the cross-sectional area of the second gap.

10. The hydraulic percussive arrangement according to claim 2, wherein the hydraulic percussive arrangement is a hydraulic drilling machine or a hydraulic hammer.

11. The hydraulic percussive arrangement according to claim 1, wherein the third chamber is arranged in a piston guide arranged in the casing.

12. The hydraulic percussive arrangement according to claim 11, wherein the piston guide further includes a fourth chamber for the bushing.

13. The hydraulic percussive arrangement according to claim 1, wherein the third chamber is arranged between a piston guide arranged in the casing and a bushing arranged in the casing.

14. The hydraulic percussive arrangement according to claim 13, wherein the bushing arranged in the casing further includes a fourth chamber for the bushing on the first side of the first chamber.

15. The hydraulic percussive arrangement according to claim 1, wherein the height of the third gap is 0.5-10 times the height of the second gap.

16. The hydraulic percussive arrangement according to claim 1, wherein the length of the third gap is 50-500 times the height of the second gap.

17. The hydraulic percussive arrangement according to claim 1, wherein the cross-sectional area of the first passage is at least twice the cross-sectional area of the second gap.

18. The hydraulic percussive arrangement according to claim 1, wherein the hydraulic percussive arrangement is a hydraulic drilling machine or a hydraulic hammer.

19. A drilling rig with a hydraulic percussive arrangement according to claim 1.

20. A piston guide for mounting in a casing of a drilling machine with a piston, such that a gap is formed between the piston guide and the piston in the sideways direction of the piston and between a first chamber and a second chamber with a pressure of hydraulic oil that is higher than that in the first chamber along the longitudinal direction of the piston, wherein the piston guide includes a third chamber arranged such that it is fixed arranged during the mounting between the gap and the first chamber, such that the third chamber is connected to the first chamber not only by a first passage but also by another gap along the piston.

* * * * *